US006543633B1

(12) United States Patent
Field

(10) Patent No.: US 6,543,633 B1
(45) Date of Patent: Apr. 8, 2003

(54) SAFETY CONTAINER

(76) Inventor: Nicola Field, 1 Manor Avenue, Thornbury Heights, Rochestown, Cork (IE)

( * ) Notice: Subject to any disclaimer, the term of this patent is extended or adjusted under 35 U.S.C. 154(b) by 215 days.

(21) Appl. No.: 09/617,788

(22) Filed: Jul. 17, 2000

(30) Foreign Application Priority Data

Jul. 16, 1999 (IE) ..... 990605

(51) Int. Cl.[7] ..... B65D 50/04

(52) U.S. Cl. ..... 215/201; 215/303; 215/329; 215/217; 220/281; 220/288; 206/1.5; 206/540

(58) Field of Search ..... 215/201, 204, 215/205, 217–219, 329, 276, 274, 303, 295; 220/319, 324, 326, 281, 288, 784, 786, 788; 206/1.5, 528, 535, 536, 540, 807, 380

(56) References Cited

U.S. PATENT DOCUMENTS 781,527 A * 1/1905 Jeffers ..... 206/536
3,023,925 A * 3/1962 Sher ..... 220/784
3,844,407 A 10/1974 Buie
4,002,258 A * 1/1977 Curry ..... 215/219
4,056,209 A 11/1977 Winkler et al.
4,614,282 A * 9/1986 Faul ..... 220/784
4,746,008 A 5/1988 Heverly et al.
4,830,206 A * 5/1989 Fisher ..... 215/209
4,905,861 A * 3/1990 Boxall et al. ..... 220/784
4,971,203 A * 11/1990 Weinstein ..... 206/536
5,099,999 A * 3/1992 Balien ..... 206/536
5,346,069 A * 9/1994 Intini ..... 220/326
5,740,938 A * 4/1998 Hofmann et al. ..... 220/324

FOREIGN PATENT DOCUMENTS

EP 0286936 A2 10/1988

* cited by examiner

*Primary Examiner*—Nathan J. Newhouse
(74) *Attorney, Agent, or Firm*—Jacobson Holman PLLC

(57) ABSTRACT

A safety container has a container body of cylindrical shape and having a cap. Opening of the cap is prevented by a safety cover which surrounds the cylindrical body. The safety cover may be removed only by a user gripping the container body through opposed ends of the safety cover using one hang, and gripping the safety cover itself with the other hand. The. configuration of the safety cover is such that a child's hand does not have sufficient span to grip the container body.

17 Claims, 5 Drawing Sheets

SAFETY CONTAINER

FIELD OF THE INVENTION

The invention relates to a safety container, particularly for prevention of access to items such as medicinal products by children.

PRIOR ART DISCUSSION

At present, there are many arrangements of such containers. One such container is described in U.S. Pat. No. 3,844,407 (Buie). This container comprises two cylindrical parts, having closed ends disposed opposite one another for thumb and forefinger compression together against an internal combined locking and moisture-seal spring device. This container is child-resistant because both particular knowledge and dexterity is required. U.S. Pat. No. 4,056,209 (Winkler et al) also describes a child-resistant container for which particular knowledge of the operating mechanism is required and it is difficult for a child to grasp the relevant parts.

However, there is in general a problem with such safety containers because they may be opened by a child having both the dexterity and the required knowledge to do so.

In another approach containers have been described which are child-resistant on the basis that the span of a child's hand is too short to open the container. The principle is that irrespective of what knowledge a child acquires and how much dexterity he or she has, it is not physically possible to open the container. U.S. Pat. No. 4,746,008 (Heverly et al) describes a box with a lid having two sets of finger-actuated latches positioned so that only two adult hands can span the distance between the latches. EP286936 discloses a container which is child-resistant on a similar basis.

While these developments are suitable for some applications, there is a need for a container which is both child-resistant and which can have a variety of sizes and shapes, including a conventional cylindrical configuration. There is also a need for such a container which is of simpler construction—not requiring complex latch and fastening mechanisms generally.

SUMMARY OF THE INVENTION

According to the invention, there is provided a safety container comprising a container body having an opening for insertion and removal of items, characterised in that the container further comprises:

- a safety cover surrounding the container body and preventing access to said opening,
- a fastening means retaining the safety cover in place surrounding the container body, and being disengageable only by relative movement of the container body and the safety cover, and
- wherein the safety cover has apertures to allow a user to grip the container body using a thumb and at least one finger, the location of the apertures being such that a child's hand does not have sufficient span to grip the container body.

In one embodiment, the apertures are located at opposed ends of the safety cover.

In another embodiment, the container body and the safety cover are of substantially cylindrical shape.

In one embodiment, the safety cover comprises an aperture revealing an end face of the container body and another aperture revealing only part of the opposite end of the container body.

In another embodiment, the fastening means is of a type whereby it is disengaged by mutual rotation of the safety cover and the container body.

In one embodiment, the fastening means comprises at least one screw thread. There may only be a single thread.

In another embodiment, the thread is located between the ends of the container body.

In a further embodiment, the container body comprises a cap for the opening.

In one embodiment, the safety cover is engaged with the cap by the fastening means.

In a further embodiment, the container body end faces are recessed behind an outer surface of the safety cover.

In one embodiment, the safety cover extends beyond the container body at an end of the container body.

In another embodiment, the container body opening is in a side wall of the container body between its ends and is solely covered by the safety cover.

According to another aspect, the invention provides a safety container comprising:

- a container body of cylindrical shape having an end wall and an upstanding side wall defining an opening;
- a cap over said opening;
- a safety cover of cylindrical shape surrounding the container body and having an aperture at each end, one aperture exposing the container body end wall and the other aperture exposing an upper face of the cap;
- wherein the separation of the apertures is such that a child's hand does not have sufficient span to grip the container body using the thumb and a finger of one hand; and
- a fastener engaging the container body with the safety cover whereby the container body and the safety cover may be disengaged by mutual rotation with one hand gripping the safety cover and the other hand gripping the container body through said apertures.

DETAILED DESCRIPTION OF THE INVENTION

BRIEF DESCRIPTION OF THE DRAWINGS

The invention will be more clearly understood from the following description of some embodiments thereof, given by way of example only with reference to the accompanying drawings in which.

DESCRIPTION OF THE EMBODIMENTS

Figure 1A:
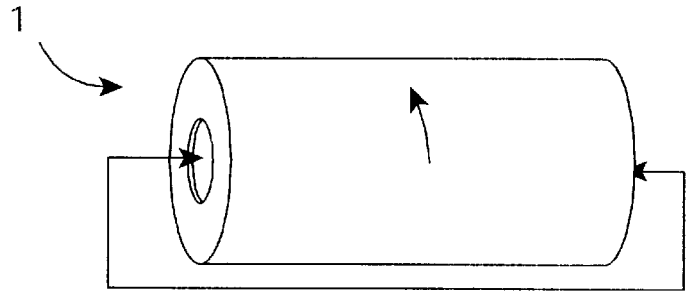
FIG. 1(*a*) is a diagrammatic view illustrating the principle of operation of a safety container of the invention, and FIG. 1(*b*) is a more detailed cross-sectional view showing the container in operation.
Figure 1B:
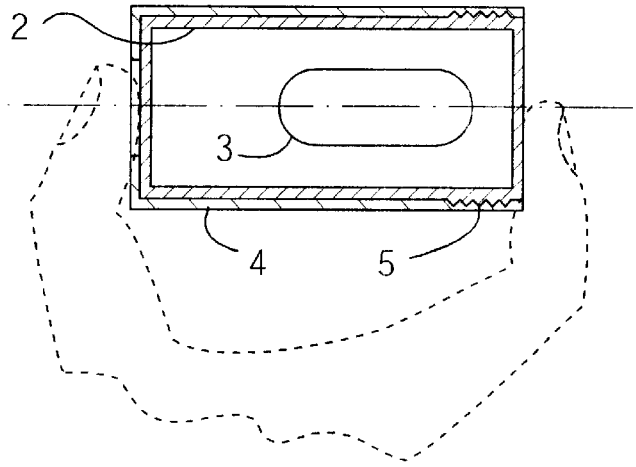

Referring initially to FIGS. 1(*a*) and 1(*b*), a safety container 1 comprises a container body 2 of cylindrical shape. The side wall of the container body 2 has an elongate opening 3 for insertion and removal of items, in this embodiment pharmaceutical tablets. However, access to the opening 3 is prevented by a safety cover 4, also of cylindrical shape. The cover 4 prevents access to the opening 3 by surrounding the full length of the container body 2 and being engaged with it by screw threads 5.

However, the safety cover 5 has an aperture at each end to allow a user to grip the container body 2 by a finger and a thumb extending through the apertures and pressing against the ends of the container body 2, as illustrated. The aperture on the right hand side of FIGS. 1(*a*) and 1(*b*) reveals the full end face of the cylindrical body 2, and the aperture on the left side reveals only portion of the left hand end face of the container body 2.

Figure 2A:
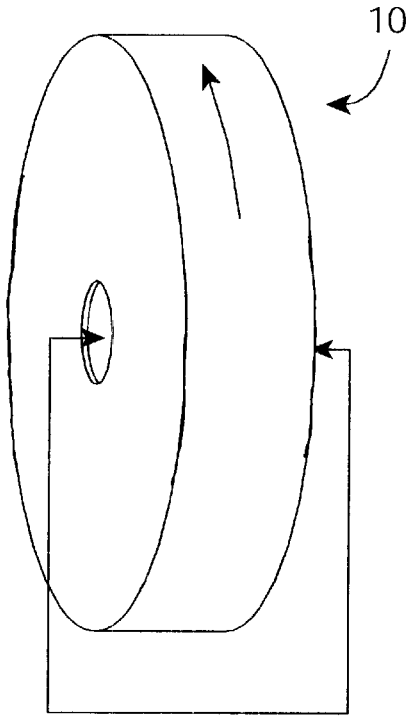
FIGS. 2(*a*) and 2(*b*) are equivalent views to those of FIGS. 1(*a*) and 1(*b*) for an alternative safety container of the invention.
Figure 2B:
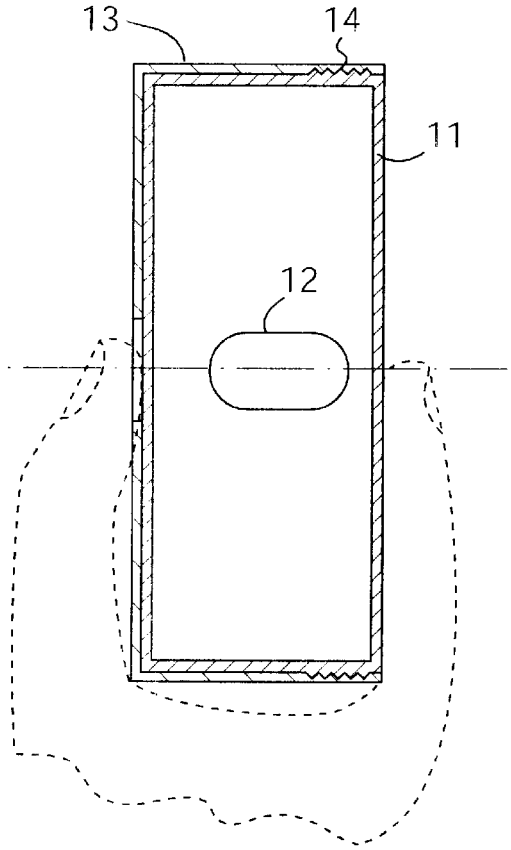

Thus, a user can grip the container body 2 through the apertures of the safety cover 4 with the thumb and a finger of one hand, and can grip the safety cover 4 with the other hand. He or she then rotates them with respect to each other to disengage them at the threads 5. However, this can only be achieved if the user's hand is sufficiently large to span the distance between the apertures in the safety cover 4. The apertures are located so that this span exceeds that of a hand of a typical child of age 6. This may be achieved by virtue of the length of the container body 2 and the safety cover 4 as shown in FIGS. 1(*a*) and 1(*b*). However, it may alternatively be achieved by virtue of the width of the safety container 1, as illustrated in FIGS. 2(*a*) and 2(*b*). In this embodiment, a container 10 has a container body 11 of short and wide cylindrical shape, a corresponding safety cover 13, and threads 14 engaging the two together. The container body 11 has an opening 12 between the ends of the body 11, however, it is shorter than that of the safety container 1. The arrows of FIGS. 1(*a*) and 2(*a*) illustrate the span to be covered by a user's hand to open the safety container. Thus, in a very simple manner the invention prevents access to items such as pharmaceutical tablets irrespective of the knowledge and/or intelligence of the child and irrespective of his or her manual dexterity. If the user's hand is not large enough, he or she is not physically capable of opening the safety container.

Figure 4A:
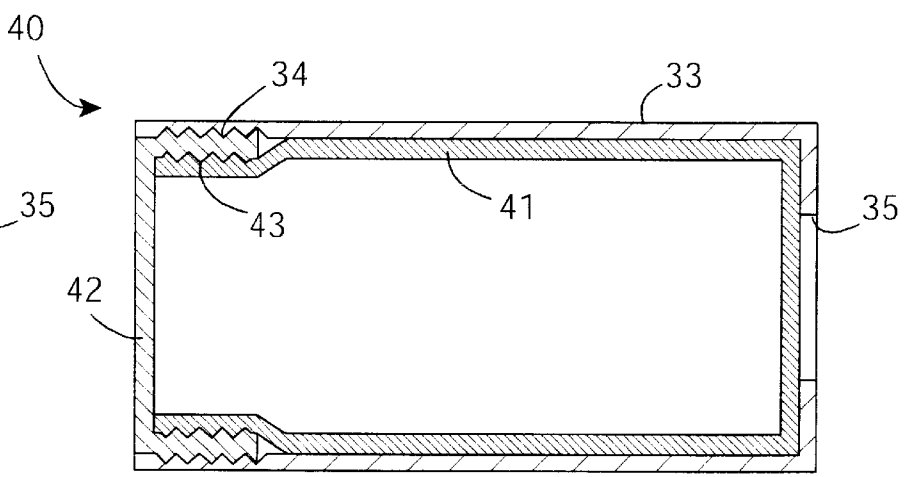
FIG. 4(*a*) is a cross-sectional view of another safety container of the invention, and FIG. 4(*b*) is a cross-sectional view of a variant of the container of FIG. 4(*a*)
Figure 4B:
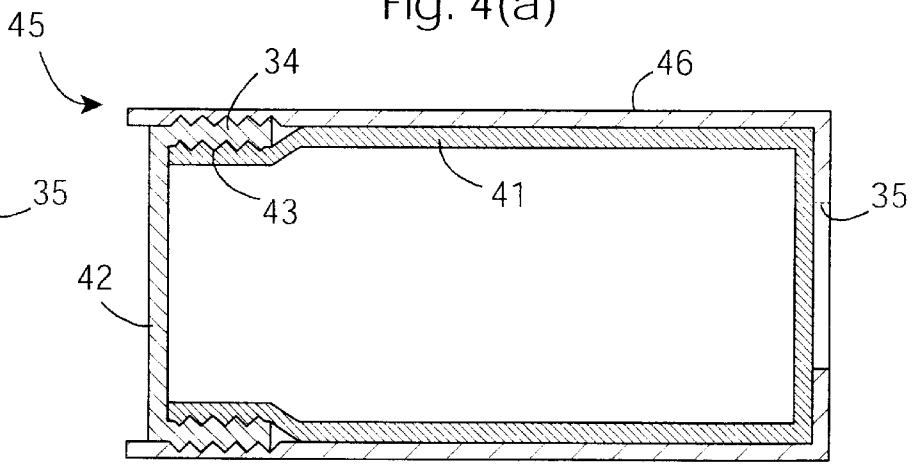
Figure 3A:
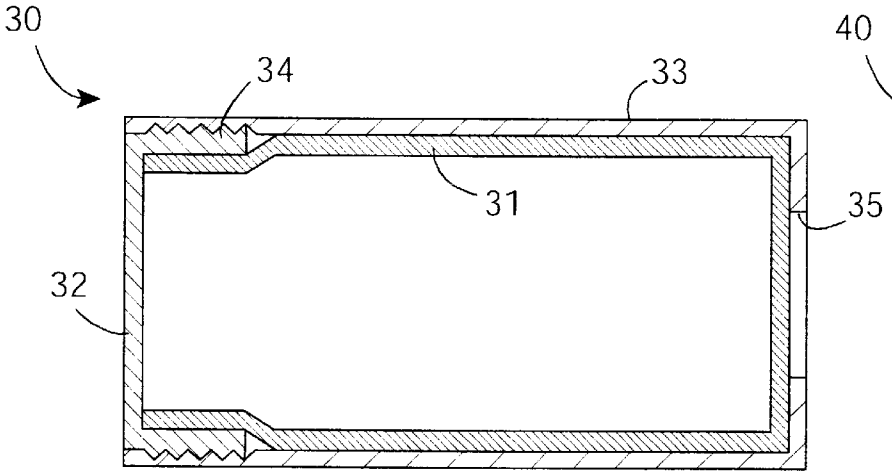
FIG. 3(*a*) is a cross-sectional view of a further safety container, and FIG. 3(*b*) is a cross-sectional view of a variant of the container of FIG. 3(*a*)
Figure 3B:
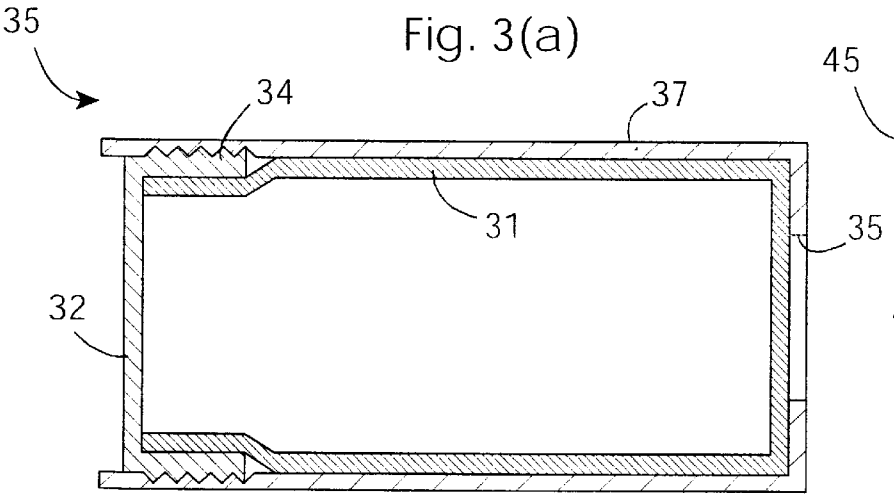
Figure 5A:
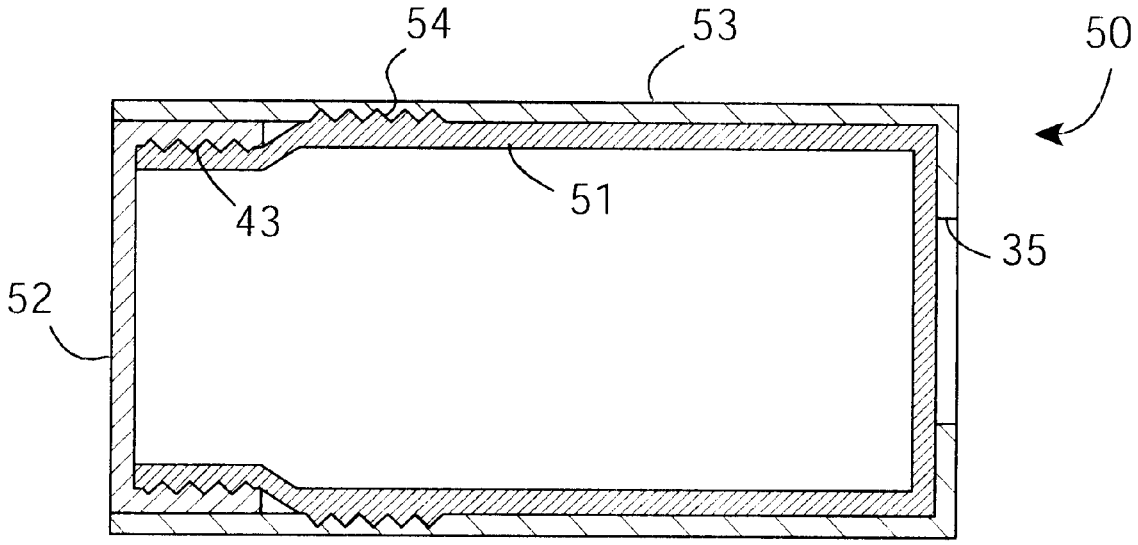
FIG. 5(*a*) is a cross-sectional view of a still further container of the invention, and FIG. 5(*b*) is a cross-sectional view a variant of the container of FIG. 5(*a*)
Figure 5B:
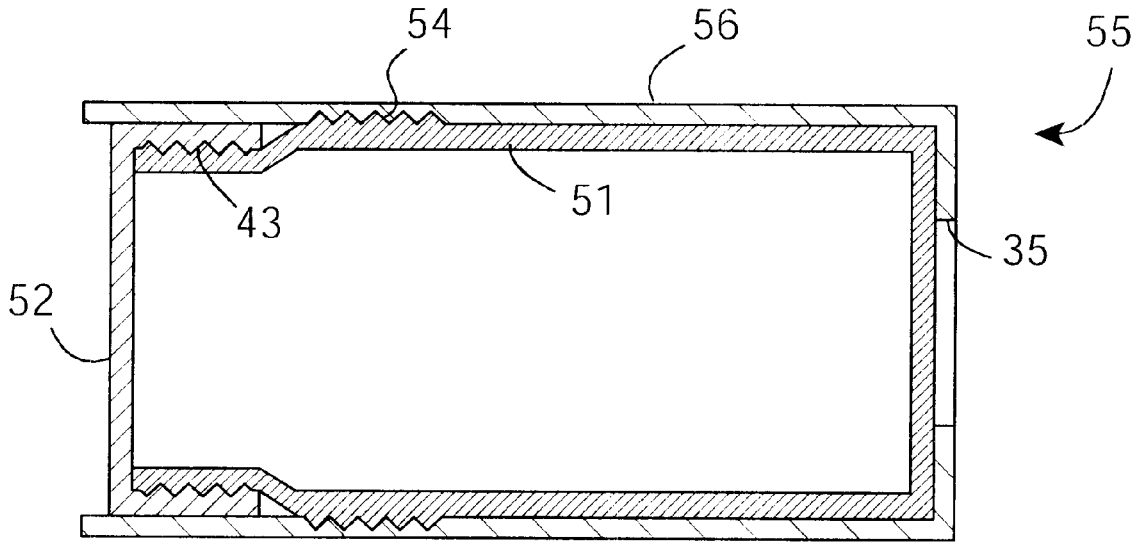

Referring to FIGS. 3 to 5 inclusive, embodiments of safety container are illustrated in which there is no opening between the ends of the container body, but instead there is an opening in one end and this is covered by a cap. A safety container 30 is shown in FIG. 3(*a*) in which there is a container body 31 having a cap 32 which is push-fitted into position. A safety cover 33 has an aperture 35. In this embodiment, the user presses, with one hand, against the cap 32 and the end of the container body 31 exposed by the aperture 35. The user grips the safety cover 33 with the other hand and mutually rotates them so that they disengage at the threads 34. When the safety cover 33 is removed, the user simply pulls off the cap 32 to gain access to the contents.

Referring to FIG. 3(*b*), a safety container 35 is illustrated, in which parts illustrated in FIG. 3(*a*) are indicated by the same reference numerals. In this embodiment, a safety cover 37 extends slightly beyond the face of the cap 32. This prevents the possibility of a child rotating the cover 37 with respect to the body 31 by pressing it down with the face of the cap 32 against a flat surface.

Referring to FIG. 4(*a*), a safety container 40 has container body 41 with an opening covered by a cap 42 which is engaged with the side wall by threads 43. Otherwise, the container 40 is similar to the container 30. Referring to FIG. 4(*b*), a safety container 45 has a safety cover 46 which is similar to the cover 33 except that it extends beyond the end face of the cap 42.

Referring now to FIG. 5(*a*), a safety container 50 has a container body 51 with an opening covered by a cap 52 engaging threads 43. A safety cover 53 engages the container body 51 below the level of the cap 52 at threads 54. A safety container 55 illustrated in FIG. 5(*b*) is similar to the container 50, except that in this embodiment a safety cover 56 extends beyond the face of the cap 52.

Figure 6:
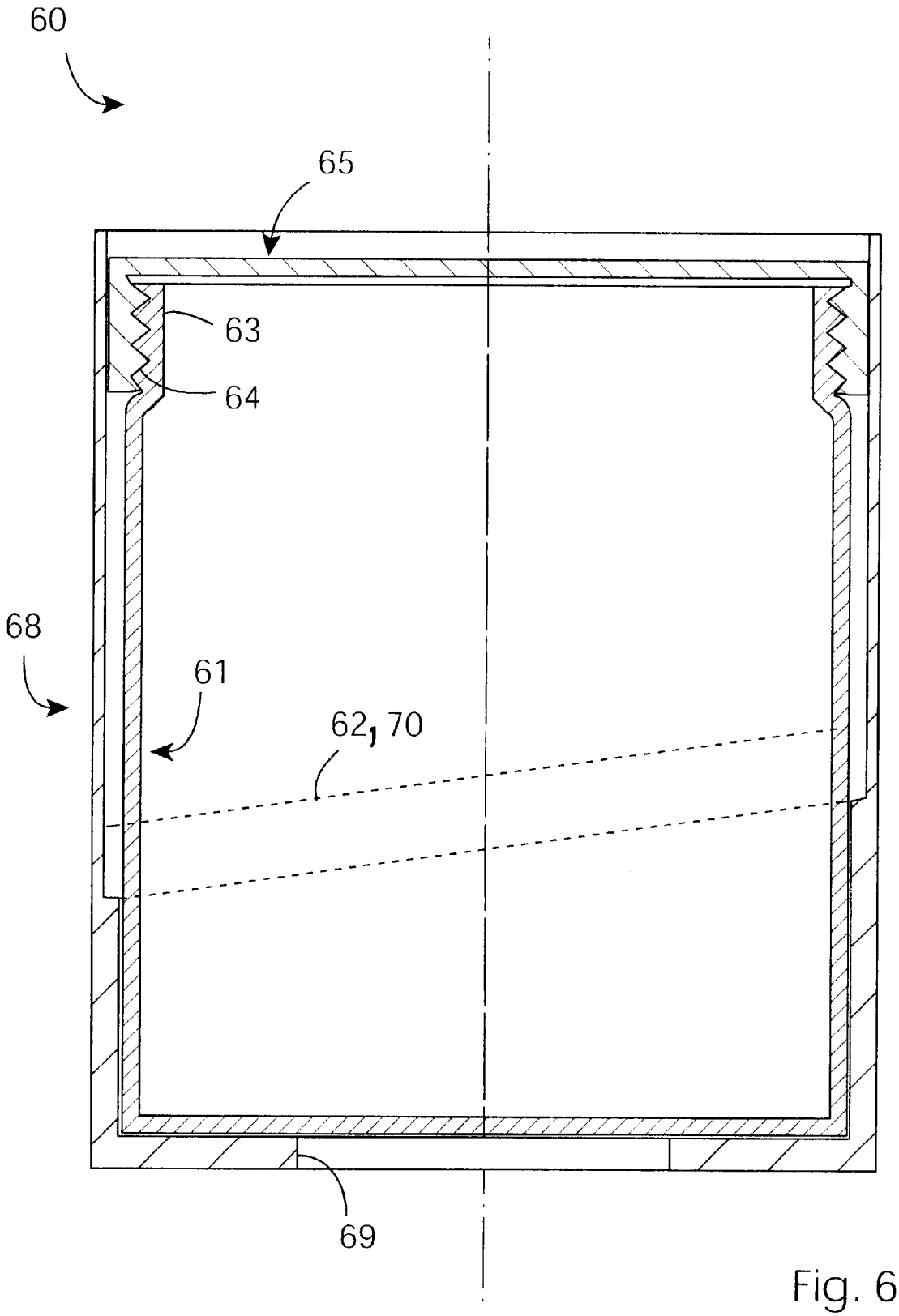
FIG. 6 is a cross-sectional view of another container of the invention.
Figure 7:
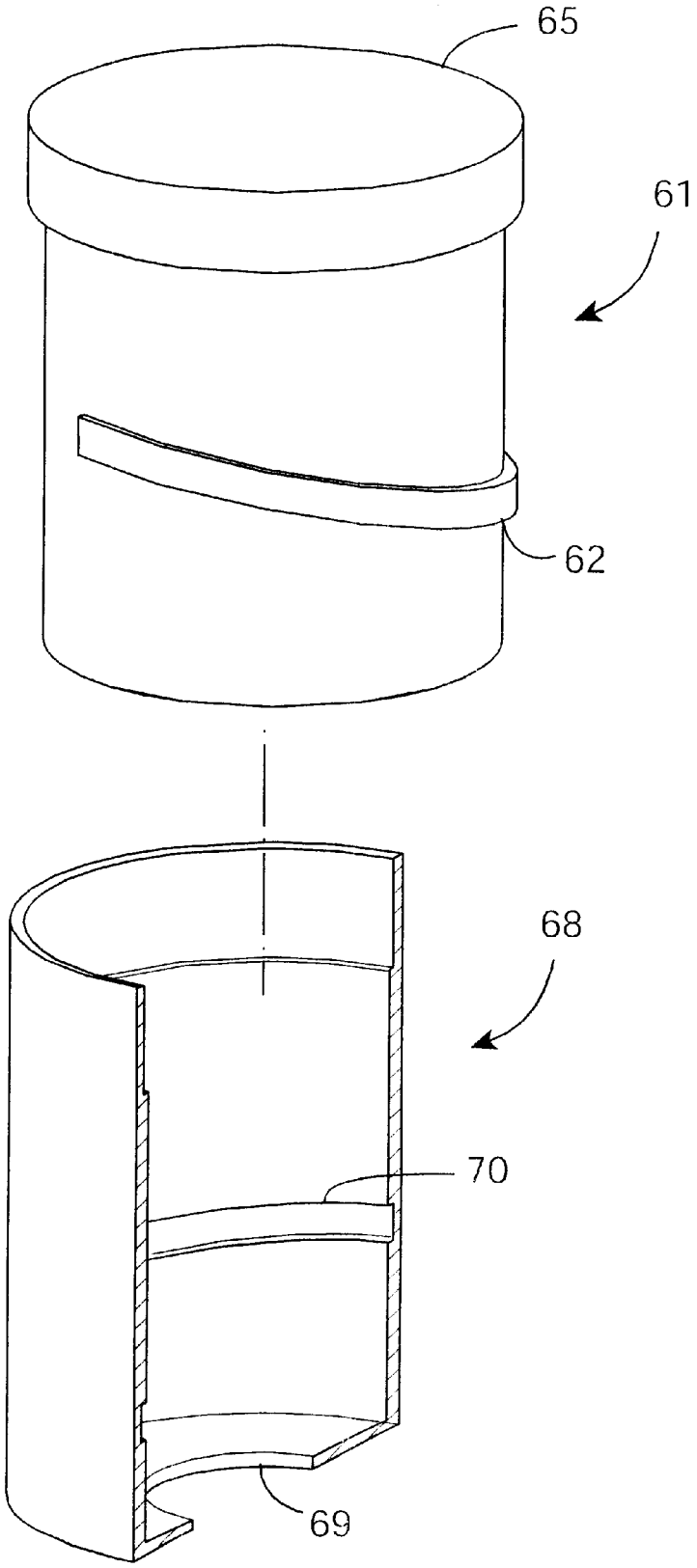
FIG. 7 is a perspective and partly cut-away view of the container of FIG. 6.

Referring now to FIGS. 6 and 7, a further safety container 60 of the invention is illustrated. The safety container 60 comprises a container body 61 having a 180° single thread 62 in the form of a rectangular ridge located between the ends of the container body 61. The container body 61 also has a mouth 63 having threads 64 engaging a cap 65. A safety cover 68 has an end aperture 69 to allow access to the base of the container body 61 and it extends upwardly around the cap 65 and slightly beyond the end face of the cap 65. The safety cover 68 has a groove 70 corresponding to the thread 62. The arrangement is most clearly illustrated in FIG. 7.

In use, the container body 61 is pushed down into the safety cover 68 and is rotated through 180° in order to engage them together. Again, the safety container 60 is opened by a user pressing a thumb and a finger against the container body 61 through the ends of the safety cover 68 to grip the container body 61, and using the other hand to grip the safety cover 68 and cause them to mutually rotate to separate them.

It will be appreciated that the invention provides a container which prevents access by children irrespective of their level of knowledge or dexterity, and yet is of simple and inexpensive construction. Also, the safety container may be in a wide variety of shapes and sizes and so may be used for many applications such as pill bottles, toiletries, or adhesives or alternatively general purpose containers for use in the household for a variety of different items. In summary, much improved child-resistance has been achieved without addition of complexity or expense as compared to the prior art.

The invention is not limited to the embodiments described but may be varied in construction and detail within the scope of the claims. For example, the fastening means may be of any suitable type for holding the safety cover and the container body together, and for allowing disengagement by mutual movement. The mutual movement may comprise longitudinal motion only, or both rotational and longitudinal motion. An example is a "bayonet" fastener. Where the mutual movement is longitudinal only, the container may have any non-circular cross-section.

What is claimed is:

1. A safety container comprising a container body having an opening for insertion and removal of items, the container further comprises:

a safety cover surrounding the container body and preventing access to said opening, a fastening means retaining the safety cover in place surrounding the container body, and being disengageable only by relative rotation of the container body and the safety cover, wherein the safety cover has apertures to allow a user to grip the container body using a thumb and at least one finger, the location of the apertures being such that a child's hand does not have sufficient span to grip the container body (61), and wherein the container body and the safety cover are of substantially cylindrical shape.

2. A safety container as claimed in claim 1, wherein the apertures are located at opposed ends of the safety cover.

3. A safety container as claimed in claim 1, wherein the safety cover comprises an aperture revealing an end face of the container body and another aperture revealing only part of the opposite end of the container body.

4. A safety container as claimed in claim 1, wherein the fastening means comprises at least one screw thread.

5. A safety container as claimed in claim 4, wherein the fastening means comprises a single thread.

6. A safety container as claimed in claim 5, wherein the thread is located between the ends of the container body.

7. A safety container as claimed in claim 1, wherein the container body comprises a cap for the opening.

8. A safety container as claimed in claim 7, wherein the safety cover is engaged with the cap by the fastening means.

9. A safety container as claimed in claim 1, wherein the container body end faces are recessed behind an outer surface of the safety cover.

10. A safety container as claimed in claim 1, wherein the safety cover extends beyond the container body at an end of the container body.

11. A safety container as claimed in claim 1, wherein the container body opening is in a side wall of the container body between its ends and is solely covered by the safety cover.

12. A safety container comprising:

a container body of cylindrical shape having an end wall and an upstanding side wall defining an opening;

a cap over said opening;

a safety cover of cylindrical shape surrounding the container body and having an aperture at each end, one aperture exposing the container body end wall and the other aperture exposing an upper face of the cap;

wherein the separation of the apertures is such that a child's hand does not have sufficient span to grip the container body using the thumb and a finger of one hand; and a fastener engaging the container body with the safety cover whereby the container body and the safety cover may be disengaged by mutual rotation with one hand gripping the safety cover and the other hand gripping the container body through said apertures.

13. A safety container comprising a container body having an opening for insertion and removal of items, the container further comprises:

a safety cover surrounding the container body and preventing access to said opening;

a fastening means retaining the safety cover in place surrounding the container body, and being disengageable only by relative movement of the container body and the safety cover; and wherein the safety cover has apertures to allow a user to grip the container body using a thumb and at least one finger, the location of the apertures being such that a child's hand does not have sufficient span to grip the container body;

the container body and the safety cover being of substantially cylindrical shape; and the container body comprises a cap for the opening.

14. A safety container comprising a container body having an opening for insertion and removal of items, the container further comprises:

a safety cover surrounding the container body and preventing access to said opening;

a fastening means retaining the safety cover in place surrounding the container body, and being disengageable only by relative movement of the container body and the safety cover; and wherein the safety cover has apertures to allow a user to grip the container body using a thumb and at least one finger, the location of the apertures being such that a child's hand does not have sufficient span to grip the container body;

the container body and the safety cover being of substantially cylindrical shape; and the container body end faces being recessed behind an outer surface of the safety cover.

15. A safety container comprising a container body having an opening for insertion and removal of items, the container further comprises:

a safety cover surrounding the container body and preventing access to said opening;

a fastening means retaining the safety cover in place surrounding the container body, and being disengageable only by relative movement of the container body and the safety cover; and wherein the safety cover has apertures to allow a user to grip the container body using a thumb and at least one finger, the location of the apertures being such that a child's hand does not have sufficient span to grip the container body;

the container body comprises a cap for the opening.

16. A safety container comprising a container body having an opening for insertion and removal of items, the container further comprises:

a safety cover surrounding the container body and preventing access to said opening;

a fastening means: retaining the safety cover in place surrounding the container body, and being disengageable only by relative movement of the container body and the safety cover; and wherein the safety cover has apertures to allow a user to grip the container body using a thumb and at least one finger, the location of the apertures being such that a child's hand does not have sufficient span to grip the container body;

the container body end faces being recessed behind on outer surface of the safety cover.

17. A safety container comprising a container body having an opening for insertion and removal of items, the container further comprises:

a safety cover surrounding the container body and preventing access to said opening;

a fastening means retaining the safety cover in place surrounding the container body, and being disengageable only by relative movement of the container body and the safety cover;

wherein the safety cover has apertures to allow a user to grip the container body using a thumb and at least one finger, the location of the apertures being such that a child's hand does not have sufficient span to grip the container body, and the safety cover extending beyond the container body at an end of the container body.

* * * * *